US010280619B2

(12) United States Patent
Moyano

(10) Patent No.: US 10,280,619 B2
(45) Date of Patent: May 7, 2019

(54) ADJUSTABLE DAP ASSEMBLY

(71) Applicant: Edwin Moyano, Seffner, FL (US)

(72) Inventor: Edwin Moyano, Seffner, FL (US)

( * ) Notice: Subject to any disclaimer, the term of this patent is extended or adjusted under 35 U.S.C. 154(b) by 0 days.

(21) Appl. No.: 15/436,803

(22) Filed: Feb. 18, 2017

(65) Prior Publication Data

US 2017/0241139 A1 Aug. 24, 2017

Related U.S. Application Data

(60) Provisional application No. 62/297,416, filed on Feb. 19, 2016.

(51) Int. Cl.

| | |
|---|---|
| ***E04C 3/00*** | (2006.01) |
| ***E04C 5/06*** | (2006.01) |
| ***E04B 5/04*** | (2006.01) |
| ***E04B 1/06*** | (2006.01) |
| *E04B 1/04* | (2006.01) |

(52) U.S. Cl.

CPC ..... *E04C 5/06* (2013.01); *E04B 1/06* (2013.01); *E04B 5/04* (2013.01); *E04C 5/0645* (2013.01); *E04B 1/043* (2013.01)

(58) Field of Classification Search

CPC . E04C 5/06; E04C 5/0645; E04B 1/06; E04B 5/04; E04B 1/043

USPC ..... 52/831, 653.1

See application file for complete search history.

(56) References Cited

U.S. PATENT DOCUMENTS

| | | | | | |
|---|---|---|---|---|---|
| 701,079 | A * | 5/1902 | Peckham | A47B 57/42 | 248/243 |
| 1,288,010 | A * | 12/1918 | Isaac | A47B 57/42 | 108/147.17 |
| 1,818,418 | A * | 8/1931 | Millard | E04B 1/24 | 52/263 |
| 3,846,944 | A * | 11/1974 | Lambert | A47B 47/021 | 211/187 |
| 4,071,970 | A * | 2/1978 | Strizki | G09F 15/0006 | 40/607.05 |
| 4,278,228 | A * | 7/1981 | Rebentisch | E01F 9/635 | 248/548 |
| 4,612,751 | A * | 9/1986 | Gloppen | E04C 5/02 | 52/250 |
| 4,852,847 | A * | 8/1989 | Pagel | A47G 29/1216 | 248/145 |
| 5,289,665 | A * | 3/1994 | Higgins | E04B 1/2403 | 211/191 |
| 6,668,474 | B2 * | 12/2003 | Winterton | G09F 7/18 | 40/607.1 |
| 6,739,099 | B2 * | 5/2004 | Takeuchi | E04B 1/2403 | 403/403 |
| 7,762,038 | B2 * | 7/2010 | Ceba | E04B 1/2403 | 52/653.1 |
| 7,874,120 | B2 * | 1/2011 | Ohata | E04B 1/2403 | 52/653.1 |
| 8,011,156 | B1 * | 9/2011 | Schwan | A63H 33/044 | 52/648.1 |

(Continued)

*Primary Examiner* — Basil S Katcheves

(74) *Attorney, Agent, or Firm* — Justin Luby

(57) ABSTRACT

A vertically adjustable steel reinforcing assembly, especially adapted for effective use with dapped beam ends. The reinforcing assembly includes an upper assembly and a lower assembly. Running vertically through the center of each of the assemblies are aligning pin holes. Assembly is configured at the time of casting to accommodate most recent dap design.

2 Claims, 7 Drawing Sheets

(56) References Cited

U.S. PATENT DOCUMENTS

| | | | | |
|---|---|---|---|---|
| 8,418,425 | B1 * | 4/2013 | Santini | E04H 3/28<br>52/653.1 |
| 2008/0178551 | A1 * | 7/2008 | Porter | E04B 1/24<br>52/653.1 |

* cited by examiner

ADJUSTABLE DAP ASSEMBLY

CROSS-REFERENCE TO RELATED APPLICATIONS

This application claims priority to provisional application U.S. Ser. No. 62/297,416 filed Feb. 19, 2016. Said application is incorporated by reference herein in its entirety.

FIELD OF THE INVENTION

The present invention relates generally to pre-stressed precast concrete double tee beams used in the construction large structures.

BACKGROUND

Modern civil construction makes extensive use of pre-stressed, precast concrete beams. Parking garages and other buildings can be quickly, economically and profitably constructed using precast, pre-stressed beam members. Double tee beam shapes are widely used; typically, these members can have a top flange, a total flange-and-web depth of up to 48 inches, and a length of 60 feet.

To reduce floor-to-floor building height without losing necessary strength in the structural beam members, the web ends of these tees or double tee members can be provided with "daps." A "dap" design provides a recess in the lower corners of the beam web. When the beam is installed in the building, this recess or notch mates with a haunch, pilaster or other supporting structure, and the mating arrangement accordingly reduces the floor-to-floor height of the building. Proper steel reinforcement of the dapped beam ends is important.

Historically, these precast, pre-stressed concrete members were manufactured by specialized manufacturing or pre-casting companies, and then finished beams were sold to the building construction contractor on an as-needed, where-needed basis. But the pre-casters were required to assemble and weld their own steel reinforcing systems for the beams and other members they are casting. The proper and economical fabrication of the dap reinforcing structures was particularly difficult, time consuming and expensive. Economies of scale and mass production were only minimally available to the pre-caster who manufactures his own reinforcing assemblies. And if special steel rod sizes or other steel shapes were found to be desirable from a design standpoint, the manufacture and purchase of such special shapes can be prohibitively expensive if only a few are needed.

In order to alleviate the difficulties of reinforcing the daps, pre-manufactured steel reinforcing assemblies, especially adapted for effective use with dapped beam ends, were developed. These reinforcing assemblies are installed into the double tee daps when the double tees are cast.

The dimensions of the dap reinforcing assemblies are typically finalized and manufactured after the structural engineer has completed his design of the double tee and associated daps. If the structural engineer makes changes to the double tee or dap design after the reinforcing assemblies have been manufactured, the dap assemblies will need to be discarded and remanufactured to reflect the changes made.

Additionally, due to the fact that these dap reinforcing assemblies are designed and built for each project, any unused or spare assemblies remaining at the end of the project have no value and are discarded or recycled.

Accordingly, there is a need for dap reinforcing assemblies that allow for adjustments to accommodate design changes made to a double tee dap by a structural engineer during the course of a project to reduce waste and cost.

Additionally, there is a need for dap reinforcing assemblies that allow for adjustments to create versatility so that the same dap reinforcing assemblies can be used on multiple projects.

SUMMARY

To accomplish these objects, a vertically adjustable steel reinforcing assembly, especially adapted for effective use with dapped beam ends, is provided. The reinforcing assembly includes an upper assembly and a lower assembly. Running vertically through the center of each of the assemblies are aligning pin holes.

The upper assembly is comprised of a vertical section, a horizontal arm section, and a upper plate. The upper section is arranged so that the arm protrudes from the vertical section at predetermined height and distance from the vertical section. Spanning the length of and attached to the underside of the arm is the ell shaped plate. When cast in the double tee, the ell of the plate will align with the upper inside corner of the notch of the dap.

The lower assembly is comprised of a vertical section and a lower plate. Attached to the underside of the arm is the ell shaped plate. When cast in the double tee, the ell of the plate will align with the bottom corner of the notch of the dap.

Running vertically through the center of each of the assemblies area plurality aligning pin holes. The upper and lower assemblies are aligned so that the distance from the bottom of the upper plate and the bottom of the lower plate match the distance specified by the structural engineer. A plurality of press fit pins are inserted in the aligned pin holes, fixing the height of the overall assembly. Once the assembly is fixed to the desired height, the assembly is ready to be cast into the double tees.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

DETAILED DESCRIPTION OF THE INVENTION AND PREFERRED EMBODIMENT

Figure 1:
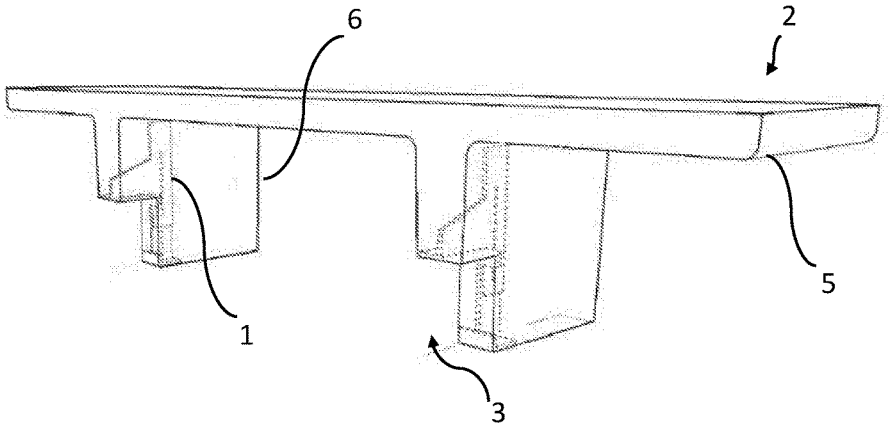
FIG. 1 illustrates a perspective view drawing of a double tee structure with adjustable dap assemblies installed.
Figure 2:
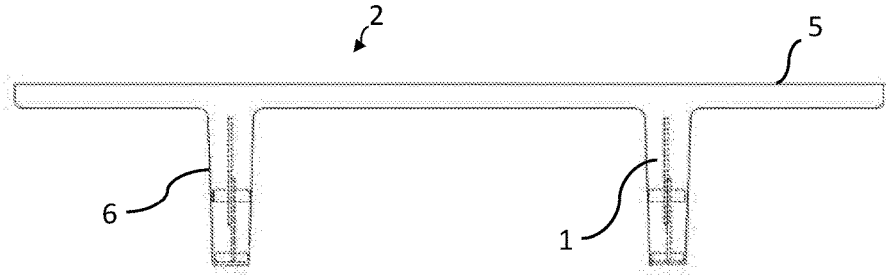
FIG. 2 illustrates a front view drawing of a double tee structure with adjustable dap assemblies installed.

Referring to FIGS. 1 & 2 the adjustable dap assemblies 1 of the present invention are reinforcement structures that are cast into pre-manufactured double tees structures 2 that utilize dapped ends 3 to reduce floor-to-floor building height without losing necessary strength in the double tees structures 2.

In general, a double tee member can be considered to include an upper flange 5, and two depending webs 6. In building a structure, double tees structures 2 are often mounted upon columnar support members. To reduce the overall height of the structure, it has been found safe and useful to form each web 6 with a rectangular notch at the lower end of the web which is known as a dap 3.

Figure 5:
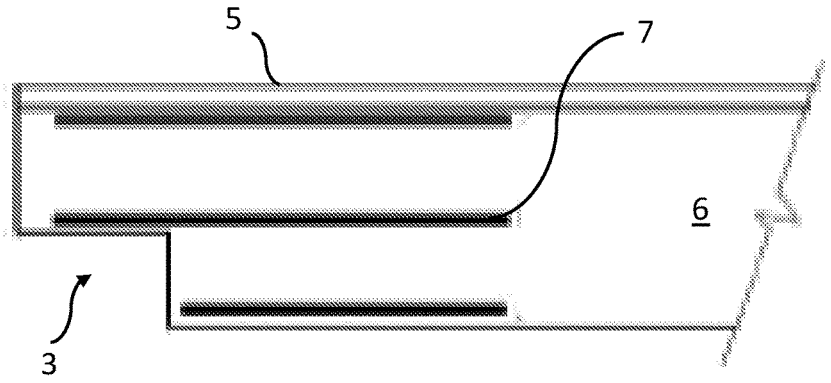
FIG. 5 illustrates a side view drawing of a double tee structure depicting how rebar is installed through the double tee structure web.
Figure 6:
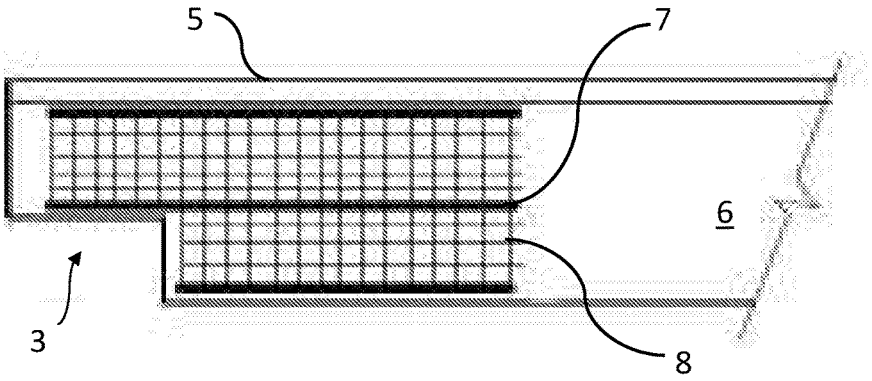
FIG. 6 illustrates a side view drawing of a double tee structure depicting how rebar and mesh web is installed through the double tee structure web.

As depicted in FIGS. 5 & 6 running fully or partly through the webs 6, particularly at the ends of the web, are reinforcing rebar 7 and mesh web 8. The mesh 8 and/or rebar 7 elements are tied to one another to provide a strong, rigid assembly which will properly take up and distribute the various vertical shear and other forces applied to the finished precast concrete double tees structures 2 in which the dap assemblies are located 1.

Figure 3:
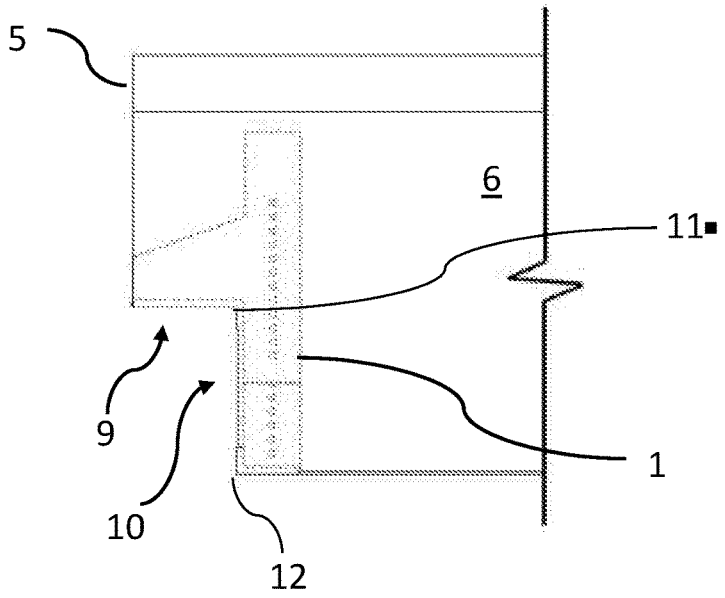
FIG. 3 illustrates a side view drawing of a double tee structure with an adjustable dap installed with the adjustable tee configured for a dapped end with a tall vertical dimension.
Figure 4:
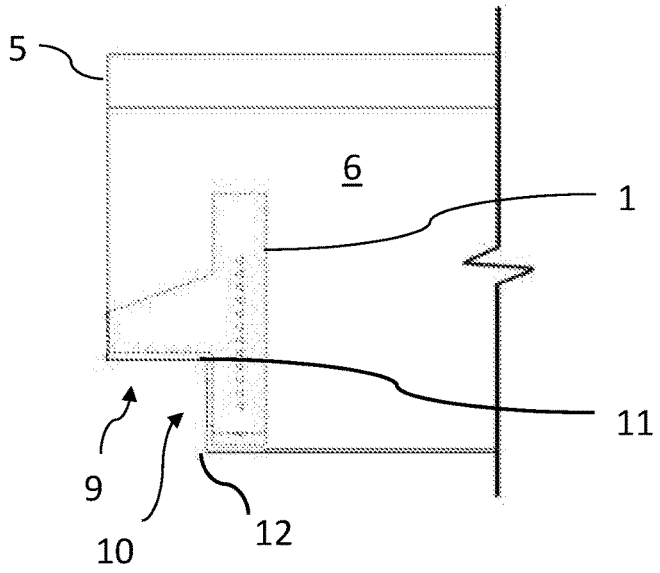
FIG. 4 illustrates a side view drawing of a double tee structure with an adjustable dap installed with the adjustable tee configured for a dapped end with a short vertical dimension.

Referring s to FIGS. 3 & 4, each rectangular dap 3 has a horizontal 9 and vertical dimension 10. These dimensions can vary based upon the required dimensions of the structure itself, the dimensions of the double tee, and the calculated loads the double tee structures are required to support.

The unusual shape of the dapped-end 3 creates severe stress concentrations localized at the upper inner corner of the dap notch 11 and at the lower corner of the dap notch 12. Furthermore, in addition to the calculated forces from external loads, dapped ends 3 are also sensitive to horizontal tension forces arising from restraint of shrinkage or creep shortening of the PC member. Therefore, if suitable reinforcement is not provided at the upper inner corner of the dap notch 11 and at the lower corner of the dap notch 12, diagonal tension cracks may propagate rapidly and failure may occur with little or no warning.

For this reason, reinforcing dap assemblies 1 are utilized to add additional support where these stress concentrations exist. The adjustable dap assemblies 1 of the current invention will provide additional support structures that cab be cast in the double tee daps 3, providing a steel surface, instead of a cement surface, at the upper inner corner of the dap notch 11 and at the lower corner of the dap notch 12 where stress concentrations occur, which is less prone to stress failure than concrete is.

Figure 7:
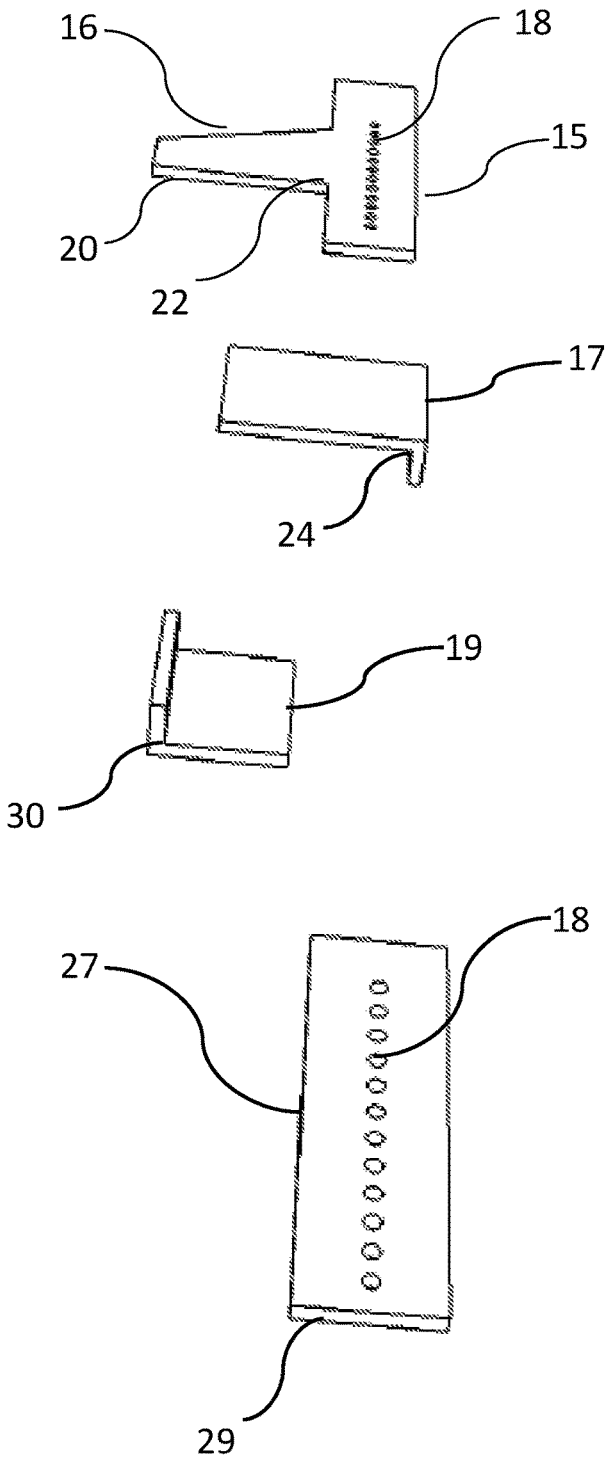
FIG. 7 illustrates an exploded perspective view drawing of the dap assembly.
Figure 8:
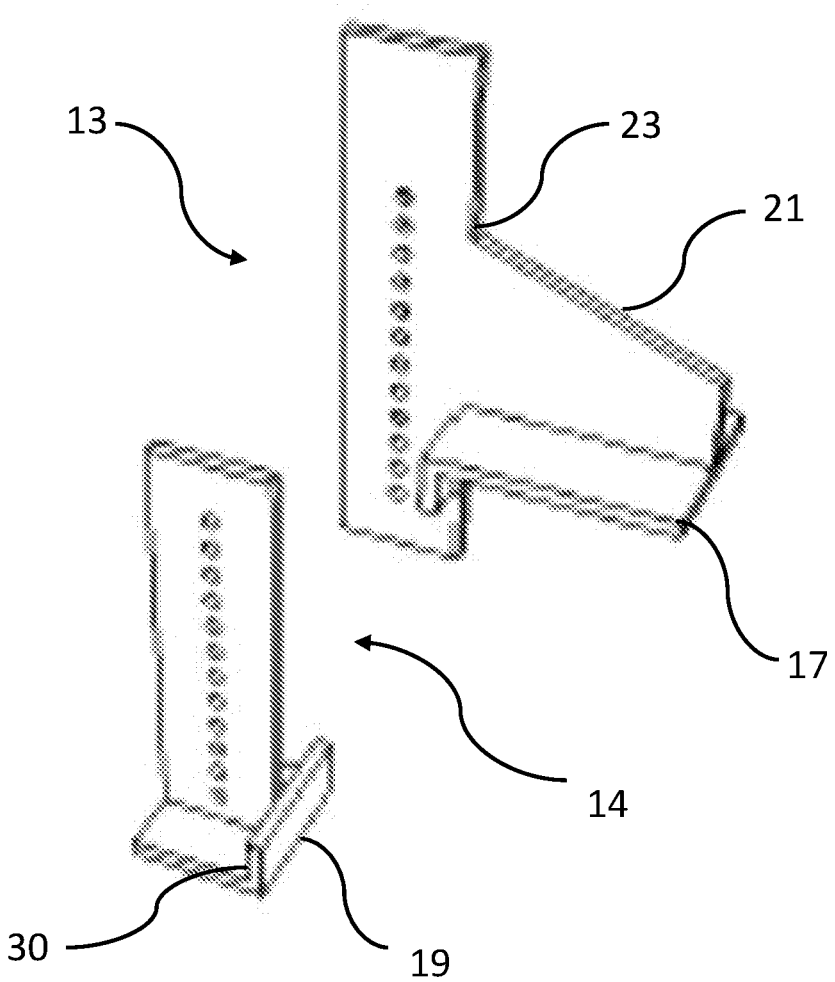
FIG. 8 illustrates an perspective view drawing of the dap assembly with the upper and lower assemblies separated.
Figure 9:
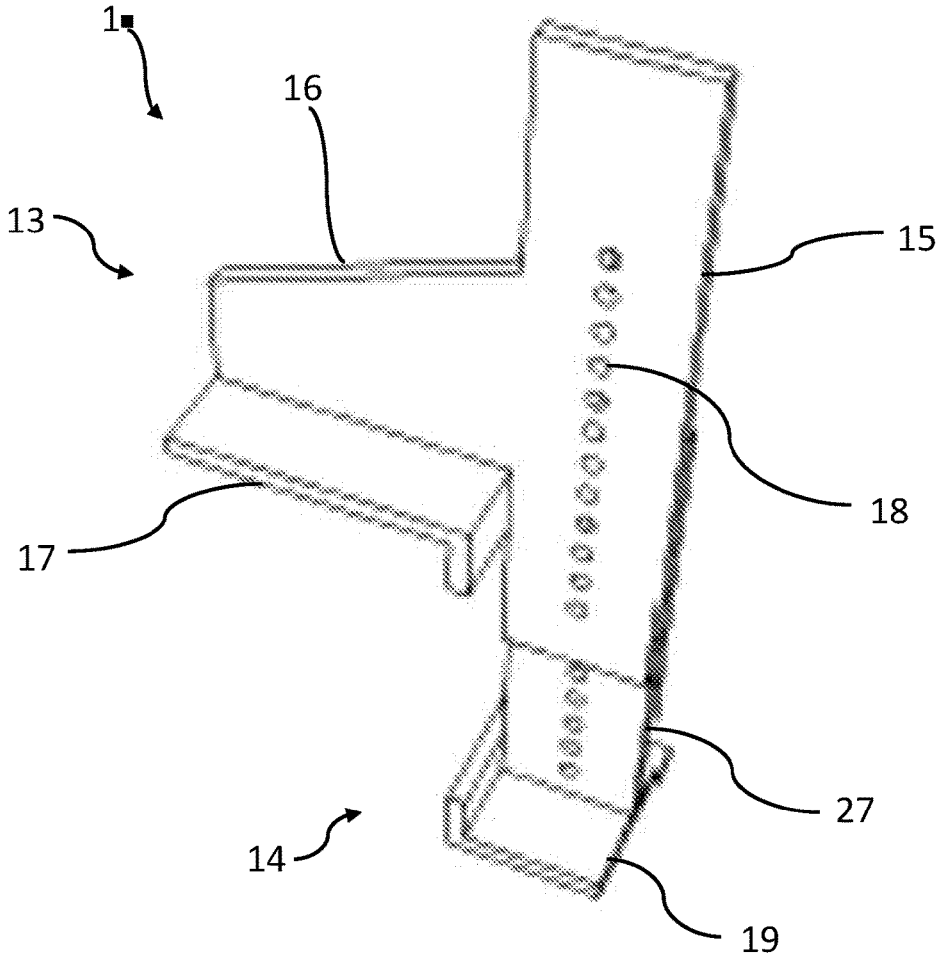
FIG. 9 illustrates an perspective view drawing of the dap assembly with the upper and lower assemblies connected.

As shown in FIGS. 7, 8, & 9, the adjustable dap assembly of the present invention is generally comprised of two pieces, an upper assembly 13 and a lower assembly 14. The two assemblies are joined to create a single rigid adjustable dap assembly 1 which can be cast into the double tee assemble 2.

The upper assembly comprises the following components: a vertical upper member 15, a horizontal arm member 16 and a upper bearing plate 17.

In the preferred embodiment the vertical upper member 15 is a flat rectangular piece of plate steel. The vertical upper member 15 functions to provide a large surface area to distribute load forces evenly throughout the web 6 of the double tee structure 2.

Running vertically through the upper vertical member 15 is a plurality of pin holes 18 drilled through the member. The pin holes 18 serve to allow the upper assembly 13 and lower assembly 14 to be affixed to each other at various distances between the upper bearing plate 17 and lower bearing plate 19. Allowing these two members to be affixed at various locations provides the adjustability which differentiates this invention from the prior art.

Protruding perpendicularly from approximately the vertical center of the vertical upper member 15 is a horizontal arm member 16. The length of the horizontal arm member 16 is roughly the same dimension as the horizontal length of the dap notch 3. In the preferred embodiment the horizontal arm member 16 is manufactured from the same piece of plate steel as the upper vertical member 15 so that the two sections are one contiguous part. Having the two members manufactured as one contiguous part increases the strength of the upper assembly 13 and reduces the potential for stress concentrations in the upper assembly 13. In the preferred embodiment of the invention the bottom edge of the arm 20 forms a right angle 22 with the vertical upper member 15 and the upper edge 21 of the arm forms an angle greater the 90 degrees 23 with the vertical upper member 15 to minimize the risk of creating a stress concentration at that connection point. The horizontal arm member 16 functions to provide and attachment location for the upper bearing plate 17 and to distribute load forces evenly throughout the web 6 of the double tee structure 2.

Affixed to the bottom edge 20 of the horizontal arm member 16 is a ell shaped upper bearing plate 17. The upper bearing plate 17 is also constructed out of flat plate steel, however, it is oriented perpendicularly with the upper vertical member 15 and horizontal arm member 16 and is welded to the upper vertical member 15 and horizontal arm member 16. The bearing please is oriented so that the right angle 24 of the ell shape is fitted to the right angle connection between the vertical member and horizontal arm member 22. The upper bearing plate 17 functions to transfer concentrated forces generated by the aforementioned stress concentrations in the upper inner corner of the dap notch 11 into general load forces which can be evenly throughout the web 6 of the double tee structure 2.

The lower assembly 14 comprises the following components, a vertical lower member 27 and a lower bearing plate 19.

In the preferred embodiment the lower vertical member 27 is a flat rectangular piece of plate steel. The lower vertical member 27 functions to provide a large surface area to distribute forces generated by the aforementioned stress concentrations in the dap evenly throughout the web 6 of the double tee structure 2.

Running vertically through the lower vertical member 27 is a plurality of pin holes 18 drilled through the member. The pin holes 18 serve to allow the upper assembly 13 and lower assembly 14 to be affixed to each other at various distances between the upper bearing plate 17 and lower bearing plate 19. Allowing these two members to be affixed at various locations provides the adjustability which differentiates this invention from the prior art.

Affixed to the bottom edge 29 of the lower member is a ell shaped lower bearing plate 19. The lower bearing plate 19 is constructed out of flat plate steel, however, it is oriented perpendicularly with the lower vertical member 27 and is welded to the lower vertical member 27. The lower bearing plate 19 is oriented so that the right angle 30 of the ell shape is fitted to the lower corner of the dap notch 12. The lower bearing plate functions to transfer the concentrated forces generated by the aforementioned stress concentrations in the lower corner of the dap notch 12 into general load forces which can be evenly throughout the web 6 of the double tee structure 2.

Figure 10:
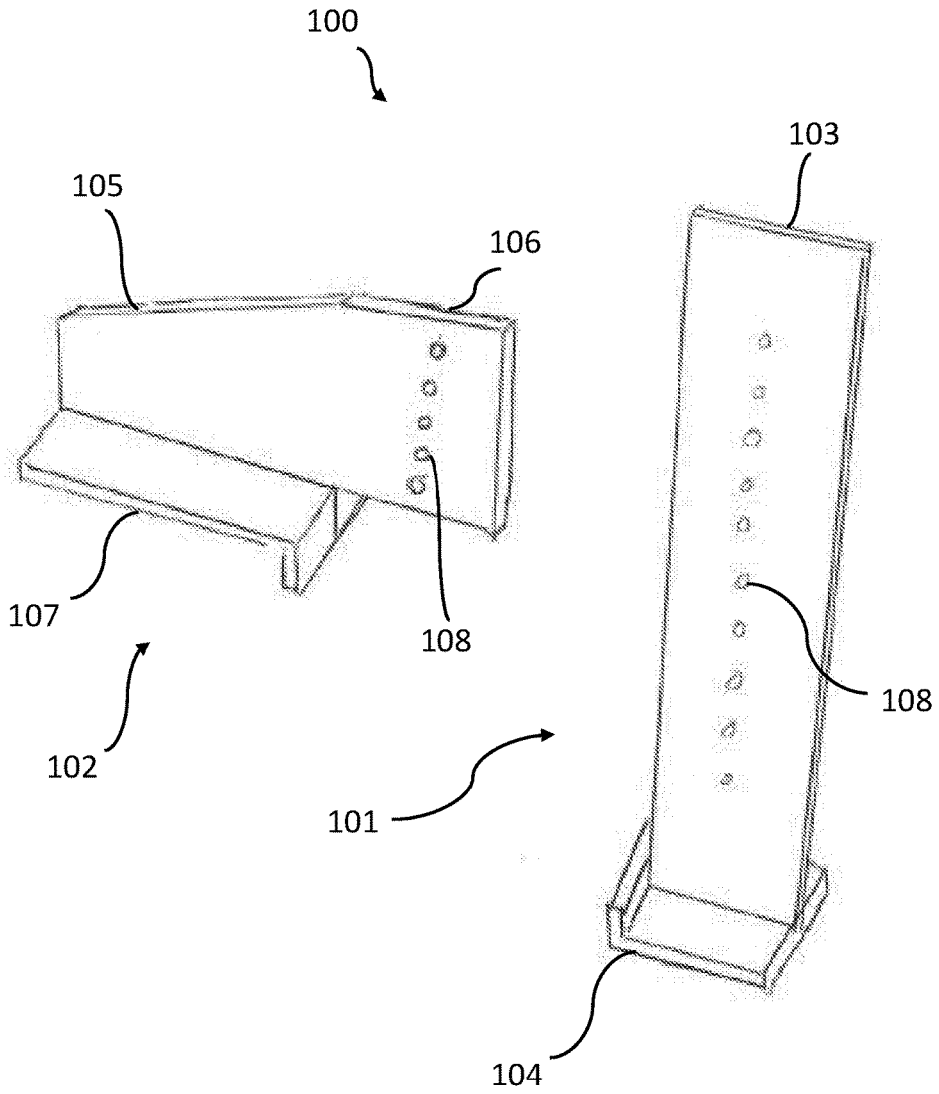
FIG. 10 illustrates an perspective view drawing of the an alternate embodiment of the dap assembly with the vertical and horizontal assemblies separated.

FIG. 10 depicts an alternate embodiment of the current inventions which is generally comprised of two pieces, a vertical assembly 101 and a horizontal assembly 102. The two assemblies are joined to create a single rigid adjustable dap assembly 100 which can be cast into the double tee assemble 2.

The vertical member is comprised of a vertical member 103, a and a bearing plate 104. The horizontal member is comprised of a horizontal member 105, a connecting flange 106, and a bearing plate 107. When installed on the adjustable dap assembly 100, the horizontal member 105 and a connecting flange 106 match the length of the dap, and the connection flange begins at the upper inner corner of the dap notch 11 and is the same width as the vertical member 103.

Running vertically through the vertical member 103 and connecting flange 106 are a plurality of pin holes 108 drilled through the members. The pin holes 108 serve to allow the vertical assembly 101 and horizontal assembly 102 to be affixed to each other at various distances between the bearing plates 104 & 107 utilizing press fit pins. Allowing these two members to be affixed at various locations provides vertical height adjustability.

At the time of manufacture of the double tee structure 2, the pre-castor will acquire the appropriate adjustable dap assembly 1 from their supply stock, based on the horizontal length of the dap (8" in the figures). The castor then will align the upper 13 and lower 14 assemblies based on the vertical height of the dap 3 and press fit the pins (not depicted) into the pin holes 18 to fix the height of the adjustable dap assembly 21.

During the casting process the castor may install into the cast the appropriate rebar 7 and/or mesh web 8 into the double tee webs 6.

What is claimed is:

1. A two piece adjustable support structure for casting into a concrete beam dap comprising:

an upper member comprising a vertical section and a lateral section and a lower member;

said upper member vertical section comprising a width, a material thickness, a top edge, a bottom edge, two sides, and a height which exceeds a vertical depth of the dap which the adjustable support structure will be cast into;

said upper member lateral section comprising a material thickness, which protrudes from the vertical section between the vertical section top edge and vertical section bottom edge where the lateral section has a top edge that extends from the vertical section at a downward angle to an end point, a bottom edge that extends perpendicularly from the vertical section to an end point, and a vertical edge which is parallel to the upper member vertical section and connecting end points of the vertical section top edge and bottom edge;

a downward facing ell shaped lateral bearing plate with a bearing plate lateral section, a bearing place vertical section, and a bearing plate width, aligned to the bottom edge of the upper member lateral section, oriented perpendicularly with the upper member lateral section, wherein the width of the bearing plate exceeds the material thickness of the upper member lateral section and the bearing plate is affixed to the upper member lateral section where the lateral section of the lateral bearing plate is affixed to said upper member lateral section and the vertical section of the horizontal bearing plate is affixed to the upper member vertical section;

wherein said vertical section of said upper member has an upper section which extends above said upper member lateral section of the horizontal support member and a lower section which extends below said upper member lateral section;

said lower member comprising a vertical section comprising a width, a material thickness, a top edge, a bottom edge, two sides, a height, and an upward facing ell shaped vertical bearing plate with a bearing plate horizontal section, a bearing plate vertical section, a bearing plate depth and a bearing plate material thickness, aligned to the bottom edge of the lower member, oriented perpendicularly with the lower member, wherein the width of the vertical bearing plate exceeds the material thickness of the lower member and vertical bearing plate horizontal section is affixed to the lower member at both the bottom edge and at least one side;

a means for allowing the upper member to be securably connected to the lower member at multiple vertical locations along the vertical support member;

wherein said upper member and said lower member can be aligned and securable affixed to each other at a proper vertical height to match the dimensions of a-dapped end at the time of casting the concrete beam dap.

2. The adjustable support structure for casting into a beam dap of claim 1, wherein said means for allowing the horizontal support member connection flange to be securably connected to the vertical support member at multiple vertical locations along the vertical member is comprised of a plurality of aligning pin holes running vertically through both the horizontal support member connection flange and the vertical support member and a plurality of press fit pins.

* * * * *